US007387232B2

(12) United States Patent
Wotring

(10) Patent No.: US 7,387,232 B2
(45) Date of Patent: Jun. 17, 2008

(54) RIDING CROP

(76) Inventor: Randall C. Wotring, 406 Green St., Big Rapids, MI (US) 49307-1926

( * ) Notice: Subject to any disclaimer, the term of this patent is extended or adjusted under 35 U.S.C. 154(b) by 259 days.

(21) Appl. No.: 11/246,446

(22) Filed: Oct. 7, 2005

(65) Prior Publication Data

US 2007/0080201 A1 Apr. 12, 2007

(51) Int. Cl.
*B68B 11/00* (2006.01)
*A63H 5/00* (2006.01)

(52) U.S. Cl. ..... 231/2.1; 446/418

(58) Field of Classification Search ..... 231/2.1; 446/418, 422, 421; 482/14, 45, 49; 294/1.2, 294/19.2; D21/400; 84/402, 404; 428/4
See application file for complete search history.

(56) References Cited

U.S. PATENT DOCUMENTS 465,066 A * 12/1891 Murphy ..... 446/421
1,509,781 A * 9/1924 Roth ..... 119/795
1,581,909 A * 4/1926 Bernhard ..... 24/1
3,799,429 A * 3/1974 Henry ..... 231/2.1
4,154,391 A 5/1979 Girty
4,187,635 A * 2/1980 Deissler ..... 446/416
4,750,670 A 6/1988 Gabe
4,986,586 A * 1/1991 Eilrich et al. ..... 294/1.2
5,873,766 A * 2/1999 Burton ..... 446/421
5,984,761 A * 11/1999 Kalinowski ..... 446/421
6,112,980 A * 9/2000 Jones ..... 231/2.1

* cited by examiner

*Primary Examiner*—Rob Swiatek
(74) *Attorney, Agent, or Firm*—Price Heneveld; G. Evaniana; S. Underwood

(57) ABSTRACT

An improved riding crop that allows a horseback rider to retain the crop on her hand without needing to tightly grip the crop includes a rod having opposite ends, a clapper fixed at one or both ends of the rod, a grip fixed to the rod or slidably retained on the rod, and an elastic cord extending from opposite ends of the grip and through an adjustable cord lock. Other preferred embodiments include a clapper fixed at each of the opposite ends of the rod, and a grip slidably retained on the rod between a clapper at one end of the rod and a stop located between the opposite end of the rod and the midpoint of the rod, which allow a rider to use either end of the crop for cueing the horse.

12 Claims, 3 Drawing Sheets

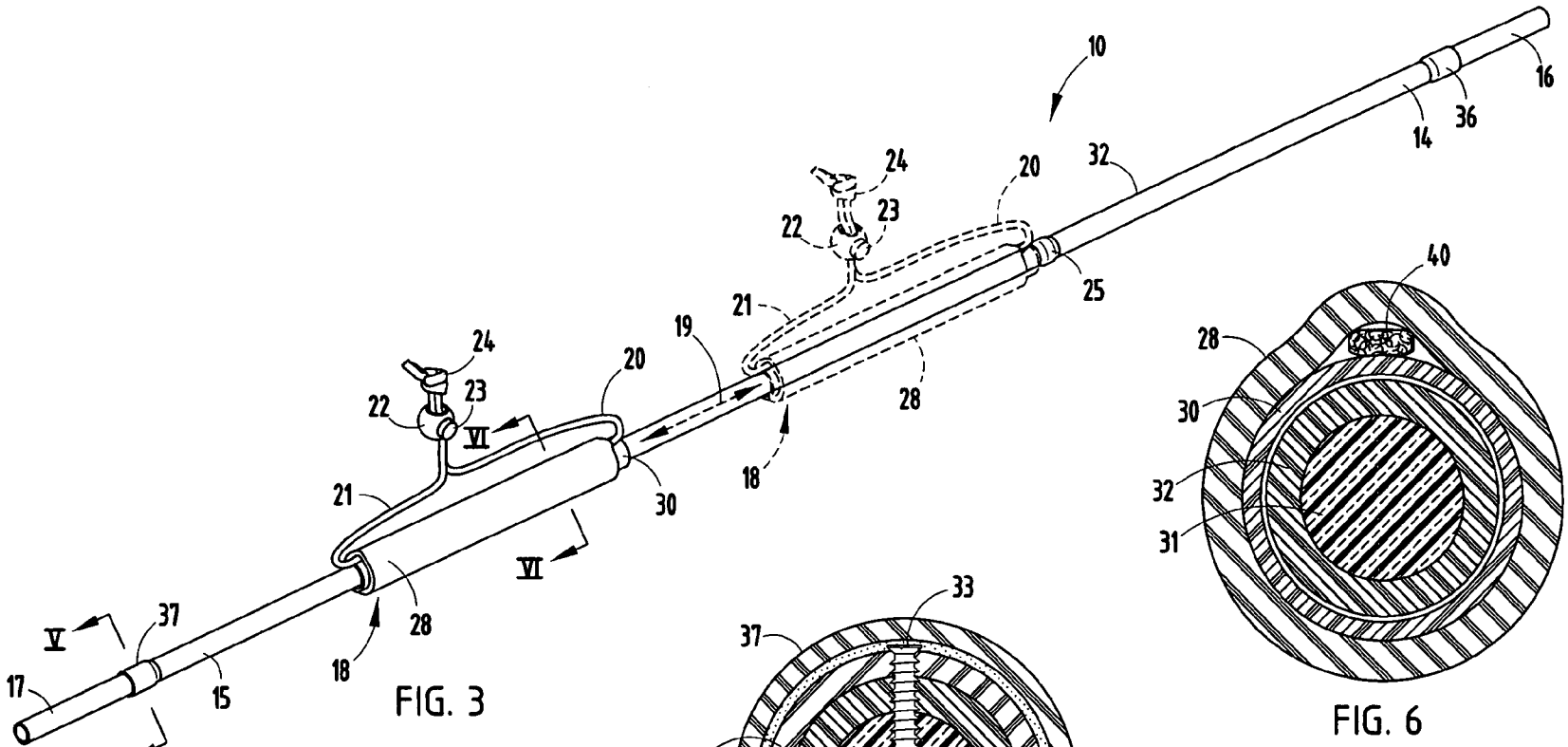
FIG. 3
FIG. 6
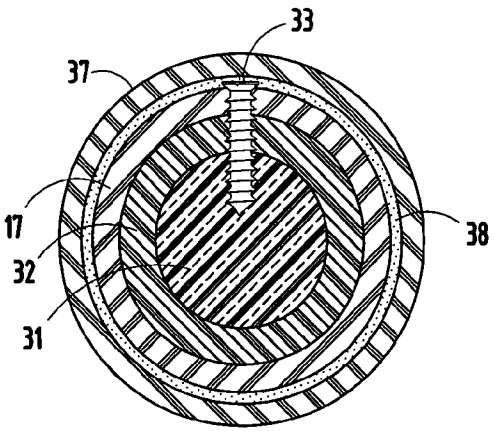
FIG. 5

RIDING CROP

FIELD OF THE INVENTION

This invention pertains to crops used during horseback riding.

BACKGROUND OF THE INVENTION

A riding crop is a type of whip used in horseback riding to supplement or amplify other cues communicated to a horse by a rider. Riding crops usually consist of a rod, typically about 60 to 70 millimeters in length, with a grip or handle fixed at one end, and a clapper, comprising a pair of overlapping leather tongues, fixed at the other end. The rod is typically comprised of fiberglass reinforced composite material to provide appropriate strength, durability and flexibility. The leather tongues strike against each other, making a clapping noise, when properly struck against the horse's rear section. In general, it is the clapping sound that cues or stimulates the horse to respond as commanded rather than the force of the strike. A typical riding crop is described in U.S. Pat. No. 4,750,670. U.S. Pat. No. 4,154,391 describes a combined riding crop and longeing whip.

There are certain disadvantages associated with the use of known riding crops. Because it is difficult to grip both reins and the typical riding crop simultaneously for an extended period of time, riders often stow the crop in their boot, a pocket or other location until it is needed. However, this results in a delay between the time the crop is needed and the time it is in hand and ready for use. Further, there is a significant risk that the crop will be dropped as it is being retrieved. As another alternative to constantly gripping the crop during horseback riding or stowing it when it is not needed, the rider could allow the crop to dangle from a strap looped around the rider's wrist. However, a crop dangling from a strap looped around a wrist of a rider tends to flop or whip around, often violently, during aggressive riding. This can be annoying, distracting and even dangerous.

SUMMARY OF THE INVENTION

In one aspect, the invention provides an ergonomically improved riding crop that incorporates a grip having an elastic strap or cord loop extending from opposite ends of the grip. The elastic strap loop allows the rider to retain the crop on her hand without needing to tightly grip the crop. Instead, the rider's hand is held between the grip and elastic loop, thereby automatically retaining the crop on the rider's hand while allowing the rider to grip and freely manipulate the reins unfettered by the crop.

In another aspect, the invention provides a riding crop having an improved tubular clapper that will, upon striking the clapper against a horse, make a clapping noise, substantially irrespective of the orientation of the clapper to the surface being struck.

In another aspect, the invention provides a riding crop having a clapper at each of two opposite ends of the crop, whereby either end of the crop may be used in striking a horse.

In another aspect, the invention provides a riding crop having a grip that slides along the crop, and a stop that limits sliding movement of the grip with respect to the crop, whereby the crop can be held in a balanced position near the center of gravity of the crop, thereby reducing the tendency of the crop to flop or whip around, such as during aggressive riding.

These and other features, advantages and objects of the present invention will be further understood and appreciated by those skilled in the art by reference to the following specification, claims and appended drawings

BRIEF DESCRIPTION OF THE DRAWINGS

FIG. 3 is an enlarged perspective view of the riding crop indicating movement of a slidable handle between a stop and a clapper at one end of the rod.

FIG. 5 is a cross section as seen along view lines V-V.

FIG. 6 is a cross section as seen along view lines VI-VI.

DETAILED DESCRIPTION OF PREFERRED EMBODIMENTS

Figures 1, 2:
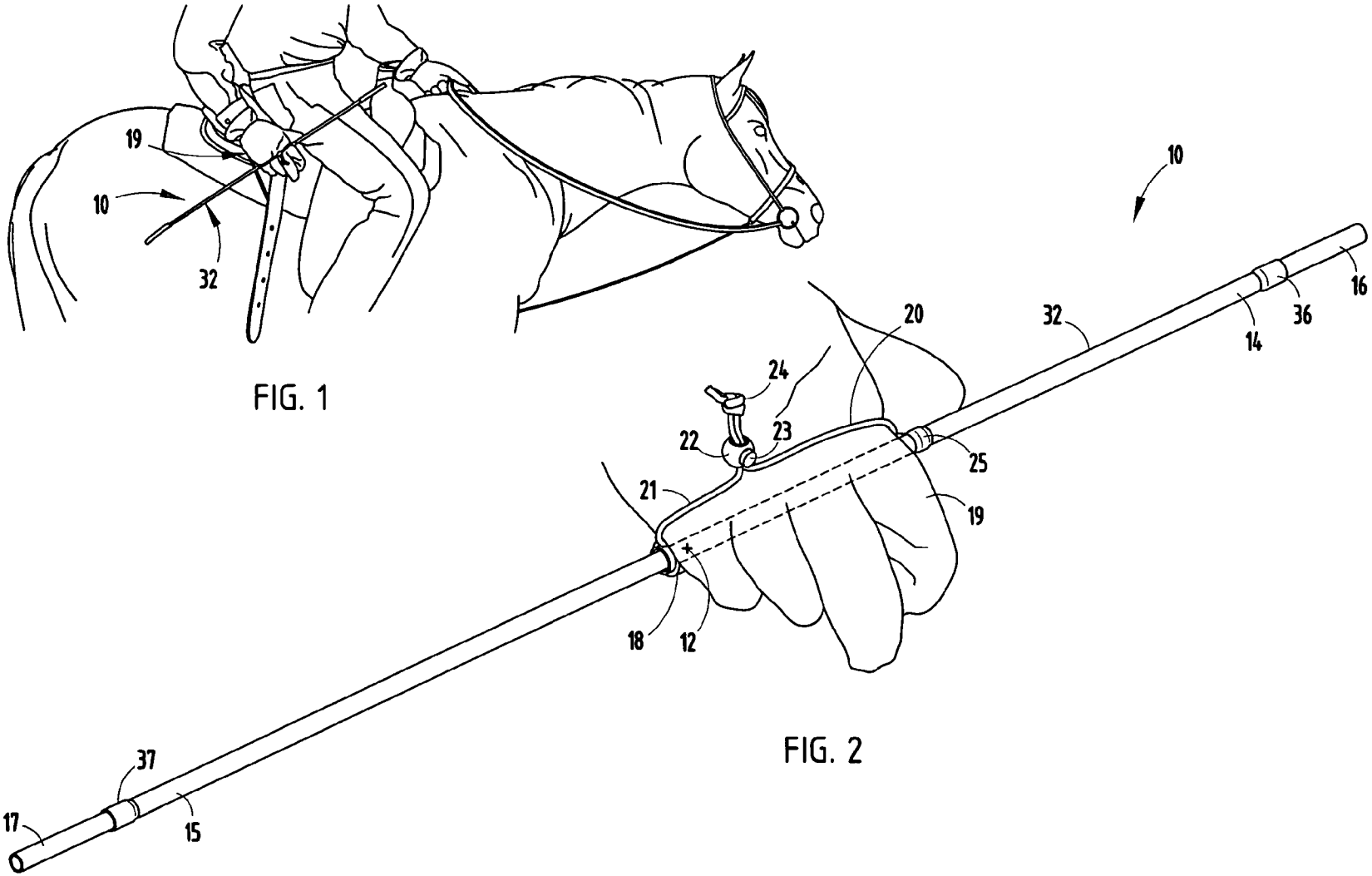
FIG. 1 is a perspective view of a rider on horseback holding a crop in accordance with the invention.
FIG. 2 is an enlarged perspective view of the crop being held on the hand of a horseback rider.

A riding crop 10 in accordance with the invention is shown in FIGS. 1 and 2. Riding crop 10 includes an elongate rod 12 having, at opposite ends 14, 15 thereof, clappers 16, 17. As used herein, the expression "clapper" is meant to encompass either two separate strips of material (e.g., leather tongues) at an end of rod 12 that slap one against the other when a clapper end of the crop is struck against a surface, or a single component having separate sections that slap one against the other when a clapper end of the crop is struck against a surface. In the illustrated embodiment, clappers 16, 17 are tubular rubber components. Tubular rubber clappers 16, 17 have an important advantage over conventional clappers comprised of two separate strips or tongues. Conventional clappers will not produce a sharp clapping sound when struck against a surface, unless the tongues are properly oriented with respect to the surface being struck. The loudest or best clapping sound is made when the first tongue strikes flat against the surface being struck and immediately thereafter the second tongue strikes flat against the first tongue. Essentially no clapping sound is made when the same strike is made with the rod rotated 90 degrees so that the surface to be struck is contacted by the edges of the tongues. When the rod is rotated at angles between these two extremes, a louder clapping sound is made as the flapper strikes flatter against the surface being struck. However, substantially the same sharp clapping sound is made when a surface is struck using a crop in accordance with the invention having tubular clappers 16 and/or 17, regardless of the relative orientation of the rod around its axis as it is being used to strike a surface.

Riding crop 10 includes a grip 18 that facilitates grasping of crop 10 in a rider's hand. Suitable grip materials that facilitate a comfortable firm grasp of crop 10 include leather, natural rubber, and synthetic rubber. A suitable and preferred commercially available material is Santoprene® synthetic rubber. Extending from opposite ends of grip 18 are straps or cords 20, 21, which can be a single piece or two separate pieces that are tied together at their ends. Straps or cords 20 and 21 extend through a spring-loaded cord lock 22 having a push button release 23. The length and/or tightness of elastic straps 20, 22 can be adjusted as desired by pressing release button 23 and, at the same time, pulling straps 20, 21 away from grip 18 through cord lock 22, and releasing pressure from release button 23. Desirably, cord lock 22, is selected so that the spring has sufficient strength to maintain the desired length and/or tension on straps 20, 21 during normal horseback riding, but will release straps 20, 21 in the event that excessive force is applied to the springs, such as if the rider falls or if the crop becomes caught on an object, thereby avoiding wrist and/or hand injury to a rider. A knot 24 is tied at the free ends of straps 20, 21 to prevent cord lock 22 from being inadvertently detached from straps 20, 21. Straps or cords 20, 21 are elastic, meaning that the cords can be repeatedly stretched or elongated by 100% and resiliently return to their original shape with less than a 1% change in dimension.

In the illustrated and preferred embodiment, grip 18 is freely slidable along rod 12 between clapper 17 and a stop 25, as indicated by arrow 19 in FIG. 3. In order to facilitate free movement of grip 18 along rod 12, grip 18 comprises a tubular grip base 30 made of a relatively hard, strong thermoplastic material, and an overlying grip layer 28, such as a leather, natural rubber or synthetic rubber layer (e.g., Santoprene® rubber). The inner diameter of tubular grip base 30 must be slightly greater than the outer diameter of rod 12 to allow free sliding movement of grip 18 along rod 12. However, the difference between the outer diameter of rod 12 and the inner diameter of tubular grip base 30 should be not be so great as to allow excessive non-axial movement of rod 12 with respect to grip 18 during normal horseback riding. A suitable and preferred material for tubular grip base 30 is linear low density polyethylene.

Figure 4:
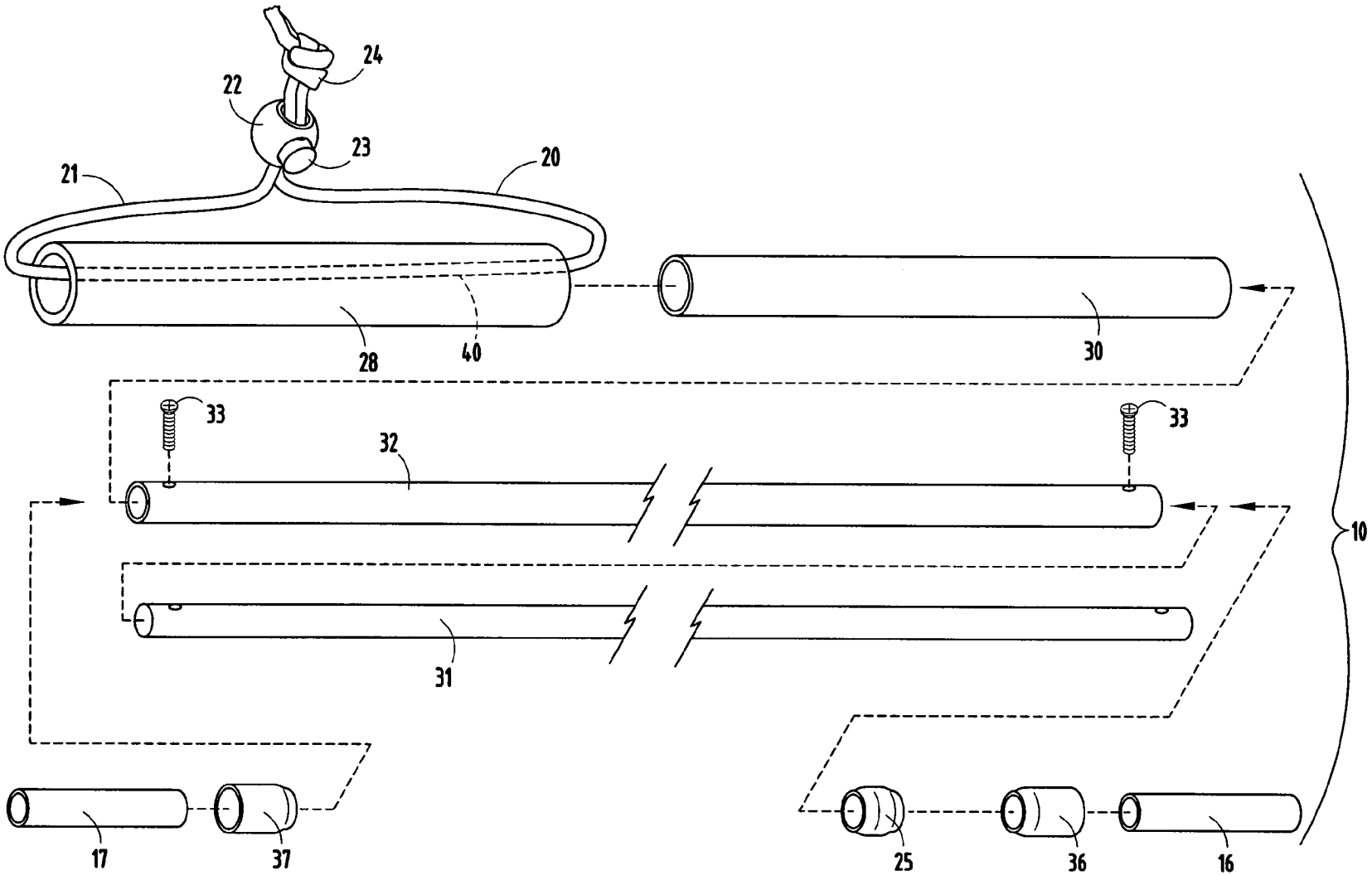
FIG. 4 is an exploded perspective view of the riding crop showing the various components and assembly of the riding crop.

FIG. 4 illustrates the components of crop 10 and facilitates understanding of its assembly. In the illustrated embodiment, rod 12 comprises a glass fiber reinforced resin composite core 31 covered by and tightly fitted within a tubular plastic sheath 32. The resin matrix of the composite is desirably a thermoset resin such as polyester, epoxy, or phenolic resins. Encasing glass fiber reinforced resin composite core 31 in a thermoplastic tubular sheath provides aesthetic advantages, protects the core, provides an improved tactile quality, and may facilitate better slidability of grip 18 relative to rod 12. A suitable material for rod sheath 32 is linear low density polyethylene.

Tubular rubber clappers 16, 17 are fastened to the illustrated embodiment by stretching one end of each of the tubular clappers over a respective opposite end of rod 12, fastening each clapper to the respective end of rod 12 with a screw 33, and heat-shrinking a band of heat-shrinkable thermoplastic material over each of the junctures between rod 12 and clappers 16, 17 to form shrink-wrap encapsulating shrouds 36, 37 over the ends of clappers 16, 17 attached to rod 12 (FIG. 5). Shrink-wrap encapsulating shrouds 36, 37 conceal screws 33 and help secure clappers 16, 17 to rod 12. An adhesive 38 may be disposed between clappers 16, 17 and shrouds 36, 37 to further insure a secure connection of clappers 16, 17 to rod 12.

Stop 25 is preferably located at a point intermediate between a top end 14 of rod 12 and the center or midpoint 26 of rod 12, typically from about 30% to 40% of the length of rod 12 from the top end 14 of rod 12. This allows riding crop 10 to be held in an upright position during riding with a sufficient portion of the weight of rod 12 being below stop 25 to avoid rod 12 from moving excessively upwardly and downwardly with respect to grip 18 when riding crop 10 is held in an upright position during normal horseback riding.

Stop 25 can be prepared by positioning a short segment of rubber tubing in an appropriate position over rod 12, fastening the rubber tubing to rod 12 with a screw, and shrink-wrapping an encapsulating shroud over the rubber tubing.

In the illustrated embodiment as shown in FIG. 6, straps 20 and 21 are actually a single strand of elastic cord having a central portion 40 that is disposed between and retained by tubular grip base 30 and rubber grip 28 (FIG. 6).

Slidable grip 18 allows a horseback rider to continue to hold riding crop 10 in an upright position, and reach back to gently strike the rear of the horse, or, if necessary, to turn riding crop 10 upside down so that grip 18 abuts clapper 16 at end 15 of rod 12, and more persuasively strike the horse with clapper 17. This arrangement allows the rider to use either clapper 16 or 17, and to hold a crop near the middle of rod 12 during normal horseback riding when the crop is not needed. This reduces flopping around of the crop, normally associated with conventional crops, thereby reducing annoyance to the rider and to the horse. Also, the elastic straps and cord lock allow tension on the straps to be appropriately adjusted to facilitate retainment of riding crop 10 on a rider's hand without the rider actually having to grasp grip 18. At any moment, when the crop is needed, the crop which is held on the rider's fingers or hand by straps 20, 21 can be grasped and used as needed.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A riding crop comprising:

a rod having opposite ends;

a flexible clapper affixed to each of said opposite ends of said rod, each clapper having an axial passageway extending therethrough, with said rod extending partially into each passageway such that a distal end portion of the passageway remains open, said clapper being capable of collapsing upon itself when it has contacted a surface;

a grip slidably retained on the rod; and a stop immovably affixed to the rod; such that the grip is limited in slidable longitudinal movement by said stop; and a cord extending from the grip.

2. The riding crop of claim 1, wherein the cord is elastic.

3. The riding crop of claim 1, in which the clapper is a tubular component.

4. The riding crop of claim 1, wherein the clapper is a tubular rubber component.

5. The riding crop of claim 1, wherein the rod comprises a glass fiber reinforced resin composite, and a thermoplastic sheath.

6. The riding crop of claim 5, wherein the resin composite is a thermoset polyester, epoxy or phenolic resin.

7. The riding crop of claim 1, wherein the rod is covered by a linear low density polyethylene.

8. A riding crop comprising:

a rod having opposite ends; and a clapper fixed at each of the opposite ends of the rod; and a flexible grip slidably retained on the rod, each clapper having an axial passageway extending therethrough, with said rod extending partially into each passageway such that a distal end portion of the passageway remains open, said clapper being capable of collapsing upon itself when it has contacted a surface;

a stop immovably affixed to the rod, such that the grip is limited in slidable longitudinal movement by said stop.

9. The riding crop of claim 8, wherein each of the clappers is a tubular component.

10. The riding crop of claim 8, wherein each of the clappers is a tubular rubber component.

11. The riding crop of claim 8, wherein the slidable grip comprises a thermoplastic tubular base and an overlying grip layer.

12. The riding crop of claim 11, wherein the grip layer is comprised of natural rubber or rubber like material.

* * * * *